US008915183B2

(12) United States Patent
Becker et al.

(10) Patent No.: US 8,915,183 B2
(45) Date of Patent: Dec. 23, 2014

(54) SCREEN PRINTING SCREEN

(75) Inventors: Mike Becker, Bremen (DE); Dietmar Lütke-Notarp, Köln (DE)

(73) Assignee: NB Technologies GmbH, Bremen (DE)

( * ) Notice: Subject to any disclaimer, the term of this patent is extended or adjusted under 35 U.S.C. 154(b) by 646 days.

(21) Appl. No.: 13/121,082

(22) PCT Filed: Sep. 25, 2009

(86) PCT No.: PCT/DE2009/001330

§ 371 (c)(1),
(2), (4) Date: Mar. 25, 2011

(87) PCT Pub. No.: WO2010/034300

PCT Pub. Date: Jan. 4, 2010

(65) Prior Publication Data

US 2011/0259218 A1 Oct. 27, 2011

(30) Foreign Application Priority Data

Sep. 26, 2008 (DE) ..... 20 2008 012 829 U

(51) Int. Cl.

| | |
|---|---|
| ***B41N 1/24*** | (2006.01) |
| ***B41M 1/12*** | (2006.01) |
| ***B41F 15/36*** | (2006.01) |
| *B41C 1/14* | (2006.01) |

(52) U.S. Cl.

CPC ..... *B41N 1/247* (2013.01); *B41F 15/36* (2013.01); *B41N 1/243* (2013.01); *B41C 1/148* (2013.01)

USPC ..... 101/127; 101/128.4; 101/129

(58) Field of Classification Search

USPC ..... 101/114, 123, 127, 129, 126, 128.4

IPC ..... B41N 1/24

See application file for complete search history.

(56) References Cited

U.S. PATENT DOCUMENTS

| | | | | |
|---|---|---|---|---|
| 6,722,275 | B2 * | 4/2004 | Coleman et al. | 101/128.4 |
| 7,223,316 | B2 * | 5/2007 | Murase | 156/293 |
| 8,105,644 | B2 * | 1/2012 | Yokai | 427/98.4 |
| 8,236,689 | B2 * | 8/2012 | Schultz-Wittmann et al. | 438/670 |
| 2002/0113034 | A1 * | 8/2002 | Moon et al. | 216/2 |
| 2009/0173245 | A1 * | 7/2009 | Irisawa et al. | 101/128.21 |
| 2013/0032048 | A1 * | 2/2013 | Falcon | 101/128.4 |

FOREIGN PATENT DOCUMENTS

| | | | | |
|---|---|---|---|---|
| DE | 32 27 434 | A1 | 1/1984 | |
| DE | 202008004821 | U1 | 6/2008 | |
| DE | 102007006640 | * | 8/2008 | H01L 21/308 |

(Continued)

*Primary Examiner* — Ren Yan
*Assistant Examiner* — Marissa Ferguson Samreth
(74) *Attorney, Agent, or Firm* — Henry M Feiereisen LLC

(57) ABSTRACT

A screen printing screen, having:

a screen printing stencil carrier which is configured as a film which is provided with first recesses which are configured in such a way that they reach from one upper side to the underside of the film, and a screen printing stencil which is configured as a nonmetallic masking layer which is connected fixedly to the underside of the screen printing stencil carrier, the masking layer being provided with second recesses which lie in congruence at least partially with the first recesses of the screen printing stencil carrier in such a way that a printing medium can pass through the first recesses of the screen printing stencil carrier from its upper side in the direction of the underside and through the second recesses of the masking layer to a substrate which can be placed underneath.

12 Claims, 8 Drawing Sheets

(56) References Cited

FOREIGN PATENT DOCUMENTS

| | | | | |
|---|---|---|---|---|
| DE | 102009024874 | * 12/2010 | ..... | B41N 1/24 |
| EP | 0 985 545 | 3/2000 | | |
| EP | 1 577 116 A1 | 9/2005 | | |
| GB | 2 295 166 A | 5/1996 | | |
| JP | 2008-162277 | * 12/2007 | ..... | B41N 1/24 |
| WO | WO 96/01743 A1 | 1/1996 | | |
| WO | WO 2006/062457 A1 | 6/2006 | | |

* cited by examiner

SCREEN PRINTING SCREEN

CROSS-REFERENCES TO RELATED APPLICATIONS

This application is the U.S. National Stage of International Application No. PCT/DE2009/001330, filed Sep. 25, 2009, which designated the United States and has been published as International Publication No. WO 2010/034300 and which claims the priority of German Patent Application, Serial No. 20 2008 012 829.3, filed Sep. 26, 2008, pursuant to 35 U.S.C. 119(a)-(d).

BACKGROUND OF THE INVENTION

The invention relates to a screen printing screen which has a screen printing stencil carrier and a screen printing stencil.

During screen printing, a screen printing screen is arranged on a printing material or substrate. The screen printing screen has a screen printing stencil and a screen printing stencil carrier, the screen printing stencil being connected to the screen printing stencil carrier which is configured as a screen. The screen is formed by polyester or stainless steel threads which are woven with one another. In order for it to be possible to handle the screen printing screen, it is tensioned tautly in a screen printing frame.

The screen printing screen has free regions which can receive a printing medium such as an ink or a paste. If a doctor is guided over the screen printing screen, the printing medium passes through the free regions of the screen printing screen onto the substrate which is arranged under it. In order to produce fine printed tracks, screen printing stencils can be used which are produced photomechanically.

A screen having a small mesh width and thin mesh wires is required for a high resolution of the printed image and a high print quality. The smaller the wire spacings and the thinner the wires, the more complicated and the more expensive is the production of a screen of this type, however. In the case of thin mesh wires having a diameter of, for example, 5 micrometers, a high tensile stress can no longer be applied, with the result that a screen which is produced from said wires is relatively sensitive mechanically.

If a doctor were guided over a screen of this type, firstly the wires can be damaged quickly, and secondly the screen could have an abrasive effect on the doctor edge which comes into contact with the screen. The consequence would be a very low service life of the screen. In order to prevent this, a coating which is joined to the screen wires with a strong bond and increases the stability can be applied on the upper side and underside of the screen. A construction of this type has the disadvantage that it is complicated. Furthermore, the printed image and the resolution which can be achieved are influenced negatively by the additional coatings which possibly have to be applied multiple times in method steps which follow one another. If the surface to be printed has a relatively great roughness, the fine-meshed screen can be damaged rapidly, with the result that only a short service life is achieved.

It is therefore an object of the invention to provide a screen printing screen for technical screen printing, by way of which screen printing screen a high resolution can be achieved which has a high service life even in the case of rough surfaces to be printed, can be produced inexpensively in the process and does not have an abrasive effect on an associated doctor. Furthermore, printed tracks having thicknesses in the range from 0.5 micrometer to 100 micrometers are to be achieved by way of the screen printing screen.

SUMMARY OF THE INVENTION

The object is achieved by the subject matter of the independent patent claim. Advantageous developments of the invention are the subject matter of the subclaims.

The screen printing screen according to the invention has:

- a screen printing stencil carrier constructed as a film having first recesses extending from an upper side to an underside of the film, and
- a screen printing stencil constructed as a nonmetallic masking layer and fixedly connected to the underside of the screen printing stencil carrier, the masking layer disposed in the first recesses of the film and extending from the underside of the film in the direction of the upper side of the film, without projecting beyond the upper side of the film, the masking layer having second recesses at least partially overlapping with the first recesses of the screen printing stencil carrier so as to enable a printing medium to pass through the first recesses from the upper side of the screen printing stencil carrier in the direction of the underside and through the second recesses of the masking layer to a substrate which can-be placed underneath.

In the screen printing screen according to the invention, sensitive mesh wires which form a screen are therefore not used, but rather a film having recesses. A film is understood here to mean a flat flexible structure which is homogeneous per se and is self-supporting. For example, the film can be rolled, cast, calendered or extruded, and can be formed homogeneously from one layer or as a multiple layer composite. The use of a film in a screen printing screen is advantageous in many regards. Firstly, a film can be produced with low expenditure in such a way that it has a low surface roughness of, for example, Rz<10 micrometers (according to DIN 4768). Reference is made to the fact that the roughness Rz is equivalent to the thread strength in the case of woven screens. This property is already achieved without the application of an additional coating, with the result that, in contrast to a screen which is woven from wires, no more complicated coating measures are required, in order to smooth surface roughnesses. If a printing doctor is guided along on the upper side of a screen printing stencil carrier which is configured as a film, virtually no more abrasive loading acts on the printing doctor even without a single additional coating.

Since, in the case of the film, in contrast to woven screens, coatings are no longer required on the upper side to smooth surface unevennesses, no exposure reflections are produced on a coating either. A higher resolution and quality can therefore be achieved in the printed image. Ragged printed edges, as can occur in the case of coated screens with woven screen printing carriers, are avoided by way of this.

Furthermore, the low surface roughness of a film can be achieved on its entire surface equally. The considerable surface elevations at the crossing points of a woven screen do not occur in the case of a film. High compressive loads at crossing points can therefore also be avoided reliably with negative effects on uniform thickness and geometry of a coating and an increasing loss of elasticity and shape of the screen. A screen printing stencil carrier with a long service life can therefore be achieved by use of a film.

In addition, recesses which lie close to one another can be made in a film with low expenditure, with the result that a high resolution can be achieved during printing. In addition, in comparison with a fine-meshed screen made from wires, a film with recesses is considerably more stable mechanically. Moreover, recesses with any desired geometry can be formed in the case of a film, whereas only substantially square free spaces for passing the printing medium through are possible in the case of a screen made from mesh wires.

The use of a nonmetallic masking layer can achieve a situation where there is a low hardness of the layer which can be adapted satisfactorily to a rough surface of a substrate with a jagged topography. It is therefore also possible to print rough surfaces with a high edge sharpness.

It is advantageous if the underside of the film has a roughness Rz of less than 30 micrometers, preferably of less than 2 micrometers. Even at a layer thickness of 0.5 micrometer, the nonmetallic masking layer on the underside of the film achieves satisfactory flatness, since no topography of a screen fabric has to be compensated for. The low layer thickness brings about a situation where reflections widthwise are reduced in the case of an exposure. A low roughness of the film underside therefore makes a printed image with an even higher resolution possible. This is achieved even when the thickness of the coating on the underside, that is to say the thickness of the screen printing stencil, is relatively great. A roughness Rz of less than 30 micrometers, preferably of less than 2 micrometers, on the upper side of the film ensures that no coating is required on the upper side for flattening a rough topography, with the result that the doctor can be guided directly on the film upper side and is worn away only unsubstantially. Therefore, not only the screen printing screen but also the doctor achieves a high service life.

According to one development of the invention, the nonmetallic masking layer is formed on the basis of an emulsion. An emulsion of this type can be applied in liquid form to the film and does not require a developer. Excess material can be washed off with water after an exposure, with the result that the handling is simple. In addition, an emulsion layer can be produced with a low hardness, with the result that it can be adapted flexibly even to a rough surface topography of a substrate, such as a solar cell. Satisfactory results can be achieved with a masking layer which has a hardness in a range from 30 to 60 Sh(A).

The masking layer on the underside of the film preferably has a thickness in a range from 0.5 micrometer to 60 micrometers, with the result that a printed image having a height of from 0.5 to 60 micrometers can be built up on the substrate by way of a single printing operation, disregarding a mechanical compression of the masking layer. Greater thicknesses of the masking layer are possible without restriction, this being limited only by the desired resolution. A particularly suitable masking layer is formed on the basis of polyvinyl alcohol. A masking layer of this type can be connected particularly satisfactorily to the surface of the screen printing stencil carrier, a satisfactory connection also being achieved on the side walls of small recesses.

In another embodiment, the masking layer comprises a dry film or solid resist or what is known as a capillary film. Said dry film is laminated onto the underside of the screen printing stencil carrier. For this purpose, the dry film can comprise different layers, it being possible for an upper layer to be etched readily, in order to facilitate the connection to the screen printing carrier. The dry film is laminated only onto one side of the screen printing stencil carrier and does not penetrate completely through the holes. The dry film is exposed and developed with the negative printed image, with the result that the screen printing stencil is produced.

The masking layer can be contained at least partially in the recesses of the film. If the film has a regular pattern of recesses, a printed image which has a different arrangement than the recesses of the film can be produced by a masking layer which is applied partially in the recesses of the film.

According to one development of the invention, the masking layer is provided in the recesses of the film from the underside of the film in the direction of the upper side of the film, but does not project beyond the upper side of the film. The doctor can therefore be guided along over the smooth upper side of the film and does not have its movement impeded by projecting material of the masking layer. Here, the masking layer can be provided in such a way that it extends flatly and in one plane with the upper side of the film. However, it is equally possible that the masking layer does not reach the upper side of the film, with the result that there is a small height difference between the masking layer and the upper side of the film. If the masking layer is exposed in this last way, there is even greater certainty that no masking layer material projects beyond the upper side of the film and therefore the doctor is not impeded during a movement along the upper side.

If, in the case of the screen printing screen according to the invention with a film as screen printing stencil carrier, a masking layer is provided exclusively on the underside and possibly also in the recesses, an emulsion layer on the basis of polyvinyl alcohol is particularly advantageous, since reliable adhesion can be achieved only on these sides. In contrast to woven screen printing stencil carriers, an additional coating on the upper side is not required.

The recesses of the film can be circular, rectangular or hexagonal. A film of this type can be produced simply and forms a very homogeneous carrier. The film preferably has a thickness of from 10 to 100 micrometers and the spacing between the recesses has a width of from 1 micrometer to 50 micrometers. Here, the spacing between the recesses can vary. If, for example, recesses of circular cross section are provided, the spacing between two adjacent circles can be 1 micrometer at the narrowest point, the narrowest point resulting on an imaginary connecting line between the two center points of the circles. If a movement is carried out perpendicularly with respect to this connecting line, the spacing between the circular lines is increased correspondingly. A film having recesses of this type therefore has no bars as carrying structural elements, as are present in a mesh having wires, but rather the inverted image to a hole pattern.

If the recesses are produced, for example, by etching, very small spacings can be achieved between the recesses, by an etchant acting on a film for a sufficiently long time. As the duration of action increases, a recess is enlarged and the spacing between the recesses decreases. In the case of processing of a film using the reel to reel process, this is possible with low technical expenditure and therefore with low costs. It is likewise possible to combine recesses of different types with one another on one film and to arrange them according to the desired printed image. In the case of a film, in contrast to a woven screen, very small openings can likewise be produced simply by a short etching duration.

It is advantageous to achieve an increase in the surface roughness of the film, for example by contact with etching media such as phosphoric acid or alkaline media such as NaOH or KOH. The adhesion of the masking layer to the film can be improved in this way. It is advantageous if, in the case of the screen printing screen according to the invention, the roughness is increased selectively only on the surfaces which are to carry a masking layer. These surfaces are the underside of the film (printing side) and the surfaces within the recesses. In the case of the upper side which comes into contact with the doctor, it is advantageous if an increase of this type in the surface roughness is not carried out, since the doctor can therefore be moved more smoothly and achieves a longer service life.

The film can be a metal film which has stainless steel, copper, nickel or another metal in pure form or as an alloy. However, it is equally possible to use a plastic film, the latter preferably being reinforced with glass fibers or carbon fibers.

In contrast to a galvanically produced film, a rolled metal film can be produced with a very small flatness tolerance. For the screen printing screen according to the invention, a rolled film is preferably used with a flatness tolerance of less than 5%, preferably of less than 2.5% of the film thickness. In addition, the film should have a low roughness. In the case of a film having a thickness of 50 micrometers, a roughness Rz of <10 micrometers, in particular Rz of <1 micrometer, can be achieved inexpensively using the reel to reel process. If a metal film having a surface roughness and a flatness tolerance of this type is used for the screen printing stencil carrier, a very accurate screen printing stencil and a very accurate printed image can be produced. Depending on the requirement of resolution and quality, the recesses can be produced using the processes which are customary in the prior art, for example by laser drilling, wet etching, ultrasonic etching, erosion or punching.

In a further embodiment, the film has, on the surface, a layer for modifying the wettability and/or passivation with respect to etching media. A modification to the wettability of the screen printing stencil can be brought about, for example, by hydrophilization or hydrophobicization. Hydrophilization brings about a situation where the printing medium can pass in an improved manner through the partly very small recesses. A hydrophobicization achieves a situation where the printing medium is released more readily from the screen printing stencil, without getting caught partly in the recesses. In general, an effect of this type, in the case of which a printing medium which is introduced into the recesses remains in the recesses only to a small proportion when the screen printing screen is removed from the substrate, can be achieved by a layer which has a contact angle with water in a range of greater than 90° to 150°. A contact angle denotes the angle which a liquid drop forms on the surface of a solid with respect to said surface. In the case of the stated contact angle range, a small interaction of the printing medium with the surface of the coating can be achieved. The result can then be a printed track, in the case of which the ratio of height to width is in the region of 1:1 or greater. For applications, in the case of which a low application of printing medium is required, the coating can have a contact angle with water in a range of greater than 0° to 90° and can have a high interaction of the printing medium with the surface of the coating.

In a development of the screen printing screen, both the screen printing carrier film and the screen printing stencil are provided with a coating.

A modification to the wettability can also be achieved by a described selective treatment with alkaline media, a stainless steel surface becoming more hydrophilic after treatment with an alkaline medium.

In order to manufacture a screen printing screen as shown above, a method can be used which has the following steps:

- coating of the film on the upper side, in the recesses and on the underside with a photosensitive masking material;
- exposure of the masking material which is present on the underside and in the recesses, in predefined regions; and
- removal of the unexposed regions of the masking material on the upper side, underside and in the recesses of the film, with the result that a masking layer is formed.

In this way, a film can be manufactured which has a smooth upper side without masking layer, there being a masking layer on the underside and in the recesses.

An exposure dosage for the masking material in the recesses of the film can be selected in such a way that the masking material which is present on the underside and in the recesses of the film is exposed down to a depth which reaches at most the upper side of the film. The doctor which is guided along on the upper side therefore does not experience an obstacle as a result of the exposed masking material and can achieve a maximum service life.

An increase in the surface roughness of the film can be limited to the regions, in which an exposed masking material is to adhere to the film, with the result that improved adhesion can be achieved.

A substance which etches the surface of the film can be used to increase the surface roughness, it being possible for NaOH, KOH or phosphoric acid to be used. Here, alkaline media are particularly suitable for simultaneous degreasing. The substance can be applied by way of a doctor. The unexposed regions of the masking material can be removed by being washed out.

According to a further embodiment, the screen printing stencil carrier and/or the screen printing stencil are/is configured in such a way that a projection protrudes into the region of at least one of the first or second recesses and reduces its passage surface area for a printing medium. A projection in a recess leads to the recess not being reduced in its cross section over its entire length, but rather only in a small region. The recess can be of broad configuration outside this region, it being possible, however, for a cross-sectional reduction of the recess to be achieved by the projection for a printing medium which is to be conveyed through said recess. This makes it possible to produce fine printing tracks, although the recess can have a generous cross section apart from the projection.

The high expenditure for the accurate positioning of a screen printing stencil carrier in relation to the screen printing stencil, in order to bring a first recess with a relatively small cross section at least partially into congruence with a second recess with a likewise small cross section, therefore does not arise. Rather, work can be carried out with customary manufacturing accuracy. Moreover, the force for introducing the printing medium into a relatively broad recess with a projection which protrudes into the recess is lower than in the case of a recess which has a continuously small cross section. This is joined by the fact that a projection in a screen printing stencil or a screen printing stencil carrier increases its flexural stiffness and tensile strength. When a doctor is moved along on the surface of the screen printing stencil carrier, the screen printing screen is therefore stretched to a less pronounced extent, with the result that its geometry is retained with higher reliability. A screen printing screen of this type therefore achieves a relatively high service life.

This embodiment can advantageously be produced by electrodeposition.

The method for producing the screen printing screen which has a projection has the following steps:

- provision of a substrate
- production of a screen on the substrate
- structured galvanizing of a metal layer in the screen on the substrate
- release of the metal layer and the screen from the substrate, and
- removal of the screen, as a result of which recesses are produced in the metal layer,
- the metal layer being galvanized at least partially over the screen, in order to form at least one projection.

As a result of the electrodeposition, it is possible to achieve the growth of the projection and a reduction in the cross-sectional surface area in one step without further structuring. Etching of the metal is not required. Furthermore, the electrodeposition makes it possible to form a projection which results in a passage surface area for a recess, which passage surface area is virtually as small as desired. In the extreme case, the projection can even close a recess completely.

According to a further embodiment of a screen printing screen, at least one of the first recesses has a printing medium inlet opening on the respective upper side and a printing medium outlet opening on the respective underside, the surface area of the printing medium inlet opening of the at least one recess lying, in the case of a projection perpendicularly with respect to said surface area, at most partly above the surface area of the printing medium outlet opening of the one recess.

In the case of a construction of this type of a screen printing stencil carrier, the printing medium no longer has to be introduced into a recess normally or perpendicularly with respect to the upper side of the screen printing stencil carrier, but can also be conveyed in a direction which deviates from the normal. This facilitates the transport of the printing medium in the direction of the substrate, with the result that the printing medium can be transported through a recess with less force application by a doctor. A longer service life of the screen printing stencil carrier can be achieved in this way.

According to a further embodiment of the screen printing screen, a spacer element is provided on the screen printing stencil carrier and/or the screen printing stencil on their/its underside, which spacer element is suitable for arranging the screen printing stencil carrier and/or the screen printing stencil at a spacing from a plane, on which the substrate to be printed is placed.

According to a development of the invention, the screen printing screen has a frame with a clamping fabric for clamping the screen printing stencil carrier which is configured as a film. In an edge region, the film can have a surface structure which is suitable to receive a joining material such as adhesive in such a way that joining of the edge region with the clamping fabric can be achieved. The structure can be formed in such a way that it is made from the film or results as an inverted region comprising elements which are attached on the film. The manufacture is particularly inexpensive if the surface structures are configured with a circular, rectangular or hexagonal cross section and are manufactured at the same time as the recesses. Continuous holes in the edge region of the film are particularly advantageous, in order that a join of an adhesive or joining material can be formed in a similar manner to a pin.

The clamping fabric and the screen printing stencil carrier are preferably joined to one another by means of melted plastic, the plastic having penetrated into depressions or holes of the screen printing stencil carrier and mesh of the clamping fabric. Production can take place in such a way that the screen printing stencil carrier which is provided with through holes in the edge region is arranged above the clamping fabric. A plastic film which is melted by heat input is then placed between the screen printing stencil carrier and the clamping fabric. The molten material penetrates into the through holes of the screen printing stencil carrier and into mesh of the clamping fabric, and permanently joins the screen printing stencil carrier to the clamping fabric after cooling. This join is very strong and can be achieved with low technical complexity without adhesives and, as a result, is very suitable for inexpensive mass production.

BRIEF DESCRIPTION OF THE DRAWING

In the following text, exemplary embodiments of the invention will be explained with reference to the drawings, in which.

DETAILED DESCRIPTION OF PREFERRED EMBODIMENTS

Figure 1:
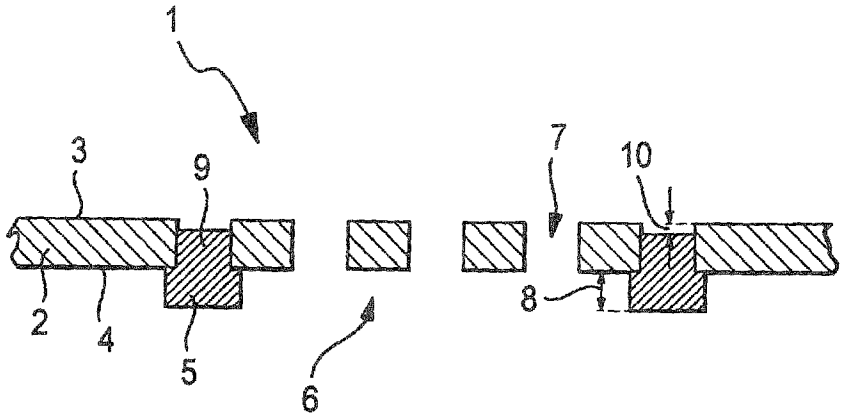
FIG. 1 shows a diagrammatic cross-sectional illustration of a first embodiment of a screen printing screen according to the invention.

FIG. 1 shows a diagrammatic cross-sectional illustration of a screen printing screen 1 according to the invention which has a film 2 as screen printing stencil carrier. The film 2 has an upper side 3 which is also called the doctor side and on which a doctor 100 with an edge 101 can distribute a printing medium 102 along the upper side 3, see also FIG. 2. A masking layer 5 is attached as screen printing stencil on the film upper side 4 which can also be called the printing side or the substrate side, since it faces a substrate or substrate, which masking layer 5 has free and nonmasked points or recesses 6 at some predefined points. Said recesses 6 can lie in congruence with recesses 7 of the film 2, with the result that the printing medium 102 can pass through the recesses 7 and 6 in the direction of the substrate 103, see FIG. 2. In relation to the underside 4, the masking layer 5 has a projection or a height 8 which approximately determines the thickness of the printing medium 102 on the substrate 103. If the masking layer 5 is compressed elastically by the doctor 100 during the pressure loading, an actual height of the printing medium which is somewhat lower than the height 8 is achieved on the substrate 103.

Figure 5:
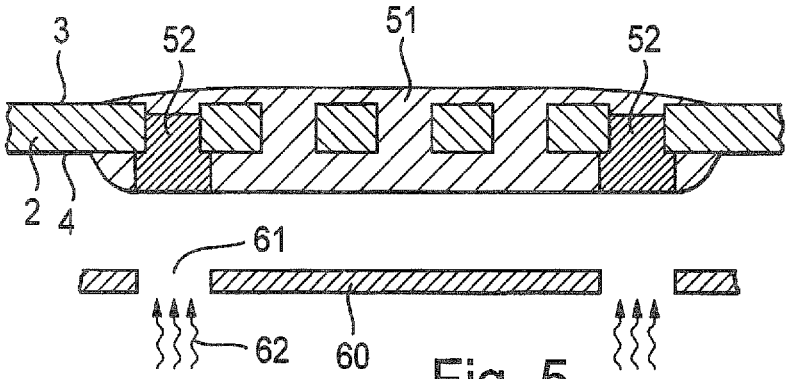
FIG. 5 shows a diagrammatic cross-sectional illustration of the second embodiment having the masking material and an associated exposure mask.

The masking layer 5 is also situated partially in the recesses 7 of the film 2, see reference sign 9. To this end, the exposure for producing the masking layer 5 takes place in such a way that, starting from the underside 4, a masking material 51 (see FIG. 5) is exposed as far as a depth which reaches until just before the upper side 3. The exposed masking material 51 forms a masking layer 5 in the cured state, there being a spacing 10 between the portion 9 of the masking layer 5 in a recess 7 and the upper side 3. However, it is also possible that the masking material 51 is exposed as far as a depth which reaches precisely as far as the upper side 3, with the result that the spacing 10 is reduced to zero. In both cases, a situation is achieved where the doctor 100 can constantly be guided along on a smooth upper side 3, without the edge 101 being abraded on an exposed part of a masking layer 5. A spacing 10 which is greater than zero increases the security in this regard and contributes to the doctor 100 not being impeded during its linear movement.

Figure 2:
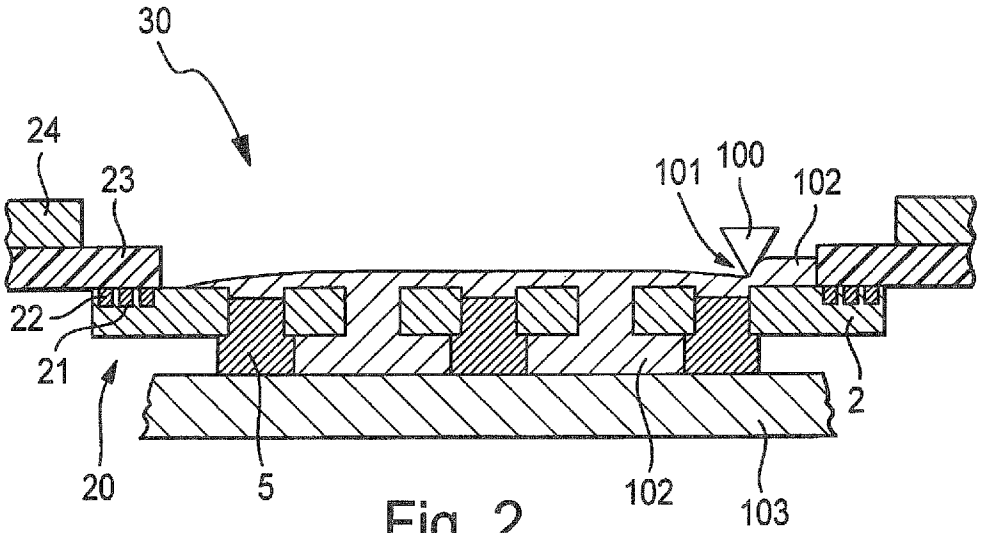
FIG. 2 shows a diagrammatic cross-sectional illustration of a second embodiment of the screen printing screen according to the invention.

As can be seen from FIG. 2 which illustrates a second embodiment of the screen printing screen 30 according to the invention, the film 2 has, in an edge region 20, a structure with depressions 21 which are suitable for receiving an adhesive 22 in such a way that adhesive bonding of the edge region 20 with a clamping fabric 23, for example made from polyester, can be achieved. The clamping fabric 23 can be gripped by a screen frame 24. The clamping fabric 23 is advantageous for absorbing the force which is exerted on the film 2 by the doctor 100. The doctor force is absorbed mainly by the clamping fabric 23 of the frame, with the result that the film 2 and the screen printing stencil 5 are deflected only slightly. As a result, the service life of the screen printing screen is increased and the accuracy of the printed image is maintained by the screen printing stencil. The combination with a metallic screen printing carrier film is particularly advantageous. The forces are absorbed by the clamping fabric 23, the metallic film remains dimensionally stable and receives the printed image precisely over a long service life.

Figure 3:
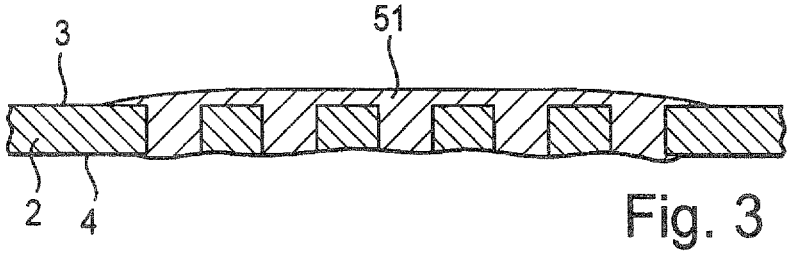
FIG. 3 shows a diagrammatic cross-sectional illustration of the second embodiment having a masking material on the film upper side and in the recesses.
Figure 4:
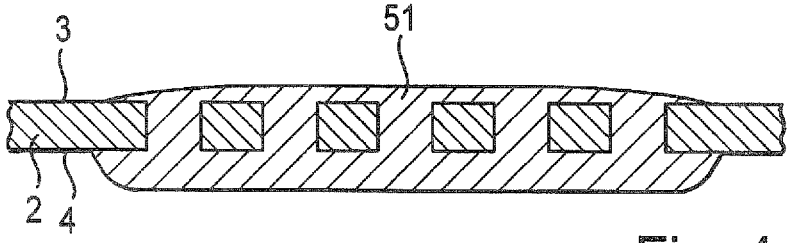
FIG. 4 shows a diagrammatic cross-sectional illustration of the second embodiment having the masking material on the film upper side, film underside and in the recesses.

The production of the screen printing screen 1 according to the invention can be carried out by way of the following method steps:

1. Joining of the film 2 to the clamping fabric 23, preferably by application of adhesive 22 or melting of plastic into depressions or through-holes 21 which are provided in an edge region 20 of the film 2, the clamping fabric 23 subsequently being enclosed in a screen frame 24.
2. Degreasing of the film 2 on its upper side 3, underside 4 and in the recesses 7.
3. increasing the roughness of the surface of the film 2 in the surface regions, on which a masking material 51 is to be applied in a later method step. The surface regions are therefore exclusively the underside 4 and the recesses 7. The greater roughness is achieved by way of an etching chemical which is applied to the underside 4 and into the recesses 7 by way of a doctor 100; said etching chemical might be, for example, media which contain NaOH, KOH or phosphoric acid. Pasty printable media having said constituent parts are particularly suitable for the selective treatment. The greater roughness achieves improved adhesion of the masking material 51 which is to be applied in the following step.
4. Coating of the surface of the film 2 with the masking material 51 in such a way that it also penetrates into the recesses 7 of the film 2 until the masking material 51 has closed the recesses 7 and has displaced air contained therein and has flattened the upper side 3 and underside 4, see also FIG. 3. The masking material 51 can be formed, for example, on the basis of polyvinyl alcohol. An emulsion is preferably used. Instead of the application of an emulsion, a dry film can also be attached to the underside of the film 2.
5. In the case of an emulsion coating, drying of the masking material 51.
6. In the case of an emulsion coating, coating of the underside 4 of the film 2 with the masking material 51 in a layer thickness which corresponds approximately to the thickness of the printed image which is to be printed later, see FIG. 4.
7. In the case of an emulsion coating, drying of the masking material 51.
8. In the case of an emulsion coating, possibly repetition of method steps 6 and 7 until the desired layer thickness is reached.
9. Exposure of the masking material 51 by means of a mask 60 having openings 61, light 62 passing through the openings 61 and in the process exposed regions of the masking material 51 curing, see designation 52. The exposure dosage is selected in such a way that the masking material 51 is exposed as far as a depth which reaches at most the upper side 3 of the film 2, see FIG. 5.
10. Washing out of the masking material 51 in the unexposed regions on the underside 4, in the recesses 7 and on the upper side 3, with the result that a screen printing screen 1 having a masking layer 5 is formed, see FIG. 1.

Figure 6:
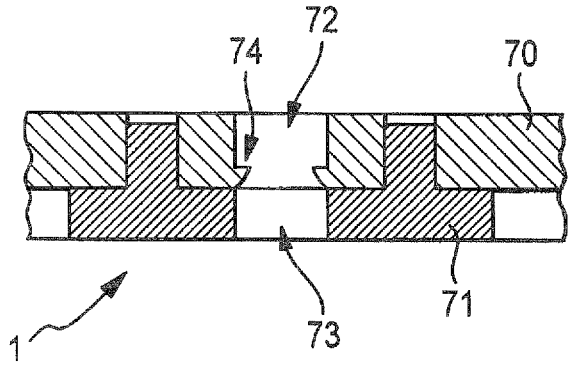
FIG. 6 shows a diagrammatic cross-sectional illustration of a third embodiment of a screen printing screen according to the invention.

FIG. 6 shows a third embodiment of the screen printing screen 1 according to the invention. The screen printing screen 1 has a screen printing stencil carrier 70 and a screen printing stencil 71 which is joined fixedly to the screen printing stencil carrier 70. The screen printing stencil carrier 70 is provided with at least one first recess 72 which has projections 74 at one end. The projections 74 extend within the first recess 72 and along the wall of the first recess 72, with the result that a uniform reduction in the cross-sectional surface area of the first recess 72 is achieved. The first recess 72 opens into a second recess 73 which is provided below the first recesses 72 and within the screen printing stencil 71. In this embodiment, the second recess 73 does not have a projection, it being possible, however, for this to be provided as an alternative or in addition to the projections 74.

Figure 10:
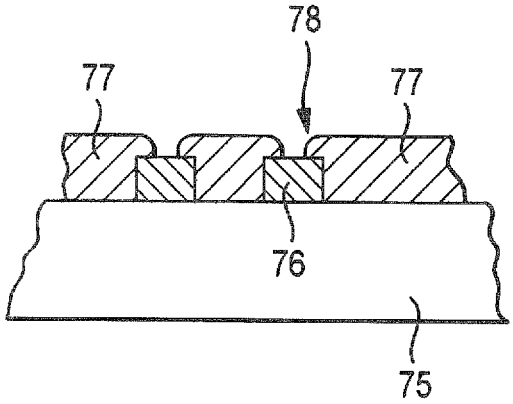
FIG. 10 shows a diagrammatic cross-sectional illustration of an apparatus during a method step for producing the third embodiment of the screen printing screen according to FIG. 6.

FIG. 10 shows a cross section of an intermediate product during the production of the second embodiment of the screen printing screen. A first varnishing form 76 has been formed on a substrate 75, whereupon a metal layer 77 has been galvanized on in a structured manner in a subsequent method step. The galvanizing operation has been carried out until the metal layer 77 has reached a height which reaches over the height of the varnishing form 76. Here, the galvanizing process has been controlled in such a way that the metal layer 77 was able to overgrow laterally onto the varnishing form 76, see designation 78, as a result of which individual regions are formed with a T structure in cross section.

If the metal layer 77 and the varnishing form 76 are subsequently separated from the substrate 75 and the varnishing form 76 is removed, recesses 72 are formed with projections 74, as is shown in FIG. 6, for example. The metal layer 77 can then act as screen printing stencil carrier 70.

Figure 7:
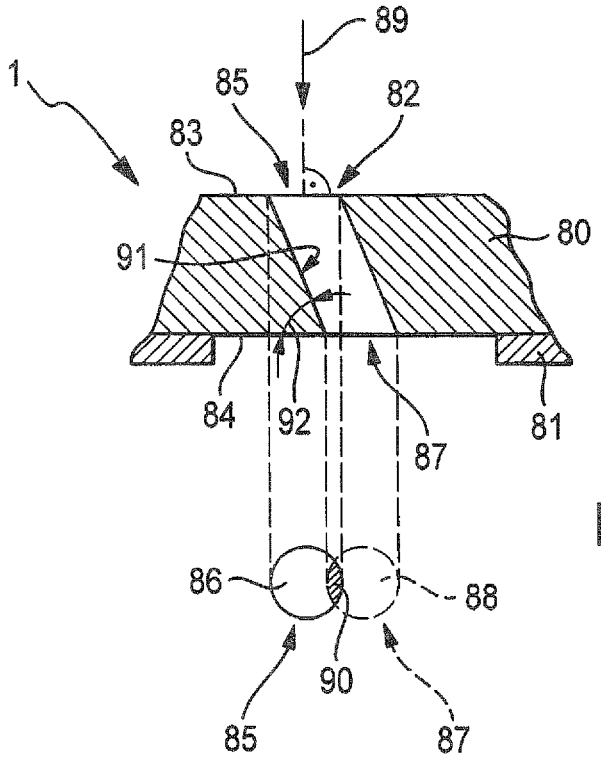
FIG. 7 shows a diagrammatic illustration of a fourth embodiment of the screen printing screen according to the invention.

FIG. 7 shows a cross section of a fourth embodiment of the screen printing screen 1 according to the invention. The screen printing stencil carrier 80 has a recess 82, the latter being provided with a printing medium inlet opening 85 on the upper side 83 and with a printing medium outlet opening 87 on the underside 84.

The screen printing stencil carrier 80 is configured in such a way that, in the case of a projection along the projection direction 89 perpendicularly with respect to this surface area 86, the surface area 86 of the inlet opening 85 lies at most partially one above the other with the surface area 88 of the outlet opening 87. This means that there is either no congruence at all of the two surface areas 86 or 88 or only a partial congruence of the two surface areas 86 or 88. The region, in which the surface areas 86 and 88 overlap partially, is denoted as overlapping surface area 90 in the following text. This overlapping surface area 90 is always smaller than the surface area 86 or 88. According to one embodiment of the invention, the overlapping surface area 90 has a size which is not more than 30% of the surface area 86 or surface area 88. The two surface areas 86 and 88 preferably do not overlap, with the result that there is also no overlapping surface area 90.

Figure 8:
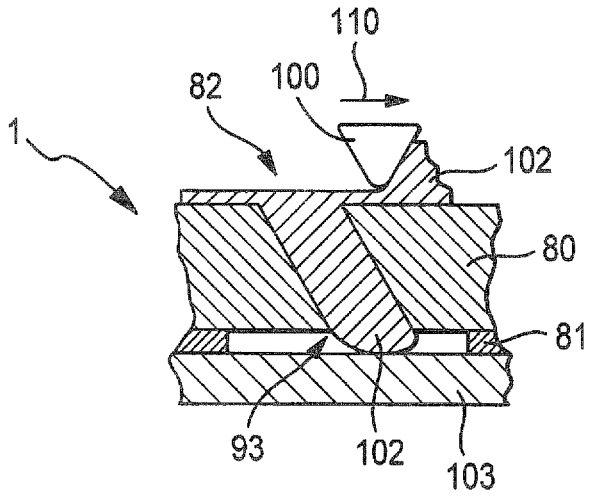
FIG. 8 shows a diagrammatic cross-sectional illustration of the fourth embodiment according to FIG. 7 with a printing medium.
Figure 9:
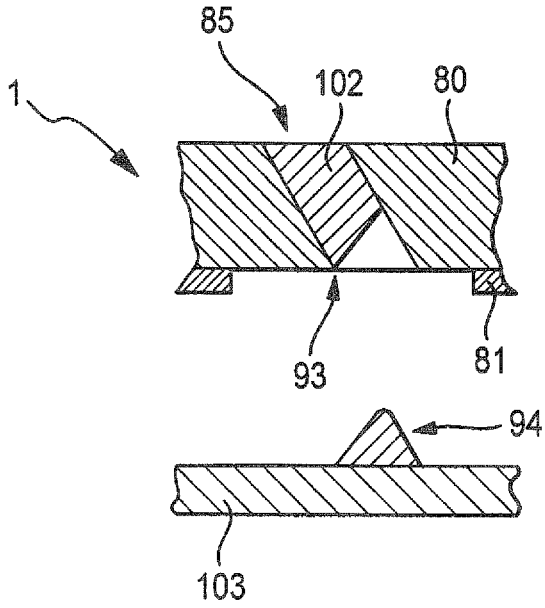
FIG. 9 shows a diagrammatic cross-sectional illustration of the fourth embodiment according to FIG. 7 with a printing medium, and a side view of a printed substrate.

In the embodiment of a screen printing stencil carrier shown in FIGS. 7 to 9, the wall 91 of the recess 82 between the inlet opening 85 and the outlet opening 87 is oriented in relation to the underside 84 of the screen printing stencil carrier 80 in an angular range of approximately 70°, see designation 92. The recess 82 is therefore inclined along its entire length from the upper side 83 as far as the underside 84 of the screen printing stencil carrier 80. In the screen printing stencil carrier 80, a printing medium 102 can be introduced more readily into said inclined recess 82 than in the case of a recess which is oriented perpendicularly with respect to the upper side of the screen printing stencil. FIG. 8 shows a printing medium 102 which has been conveyed into the recess 82 by means of a doctor 100. To this end, the doctor 100 has been pulled along in the movement direction 110, close to the upper side 83 of the screen printing stencil carrier 80.

In the situation which is shown in FIG. 8, the printing medium 102 which has been introduced completely into the recess 82 has reached the substrate 103 which is attached under the screen printing stencil carrier 80, and comes into contact with the surface of said substrate 103. If, during a following step, the screen printing stencil carrier 80 is removed from the substrate 103 by a perpendicular vertical movement upward, the edge 93 on the underside 84 acts like a tearing edge, with the result that the printing medium 102 begins to shear off at this edge 93, see FIG. 9. A part of the printing medium 102, shown here as a triangular part 94, then remains on the substrate 103, another part of the printing medium 102 remaining in the screen printing stencil carrier 80. However, on account of the tearing edge 93, the portions of the printing medium on the substrate 103 and in the screen printing stencil carrier 80 are predefined and readily reproducible, with the result that a uniform application of the printing medium on the substrate 103 is achieved.

Figure 11:
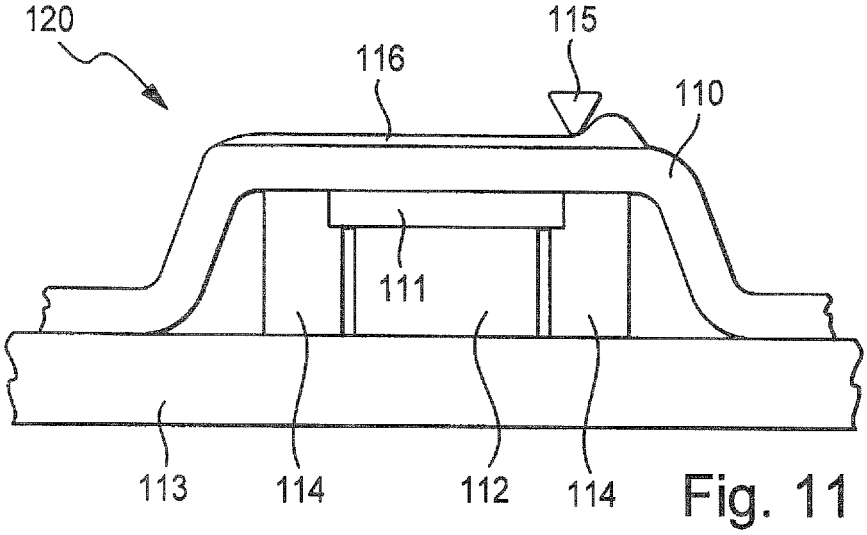
FIG. 11 shows a diagrammatic illustration of a fifth embodiment of the screen printing screen according to the invention in a side view.

FIG. 11 shows a fifth embodiment of the screen printing screen according to the invention. The screen printing screen 120 has a screen printing stencil carrier 110 and a screen printing stencil 111, the screen printing stencil 111 being in touching contact with the upper side of the substrate 112. The substrate 112 is placed on a substrate support 113. In the screen printing screen 120 according to the invention, spacer elements 114 are attached on the underside of the screen printing stencil carrier 110 and on the underside of the screen printing stencil 111. In this embodiment, they have a spacing height which reaches as far as the underside of the substrate 112 or the upper side of the substrate support 113. However, the spacer elements 114 can also be provided with a slightly smaller height, with the result that they do not reach quite as far as the underside of the substrate 112.

If a printing medium 116 is pressed through the screen printing screen 120 by means of a doctor 115, a vertically downwardly directed force acts on the screen printing screen 120. The spacer elements 114 ensure that the screen printing stencil carrier 110 is not pressed down as far as the substrate support 113 in the region of the outer edges of the substrate 112, but rather is held in a position which, in the region of the substrate 112, makes a horizontal support of the screen printing stencil 111 possible on the upper side of the substrate 112. As a result, a uniform and correct printed image can be achieved even into the edge regions of the substrate 112. Furthermore, the screen printing stencil 111 and the screen printing carrier 110 are mechanically protected in the edge regions of the substrate 112 by the spacer elements 114 if the doctor 115 is pulled along on the surface of the screen printing stencil carrier 110.

If a relatively soft substrate support 113 is used, it can occur that, while the doctor 115 is being pulled along over the screen printing stencil carrier 110 in the region of the spacer elements 114, said spacer elements 114 are pressed into the substrate support 113, with the result that the screen printing stencil carrier 110 and the screen printing stencil 111 do not rest flatly on the substrate 112 in the edge regions of the substrate 112. In this case, according to one development of the invention, the spacer elements 114 can have such a height that, in an unloaded state, that is to say without application of a vertical force by the doctor 115, in the case of contact of the spacer elements 114 with the substrate support 113, the screen printing stencil carrier 110 and the screen printing stencil 111 are situated at a spacing from the upper side of the substrate 112.

The spacer element 114 can be attached retrospectively to the screen printing stencil carrier 110 and/or to the screen printing stencil 111. It can be a flat material or a film made from plastic or metal which is configured in one piece. Furthermore, it is possible that a plurality of spacer elements 114 are arranged around the edge region of the substrate 112 at a predefined spacing from one another.

The spacer element 114 can also be machined from the screen printing stencil carrier 110 or the screen printing stencil 111. In this case, assembly and precise assignment between spacer element 114 and screen printing stencil carrier 110 or screen printing stencil 111 are no longer required, with the result that assembly complexity is omitted completely. In the case of a machined spacer element 114, no requirements are to be met with regard to fit, flatness and parallelism of surfaces which are to be joined to one another.

A spacer element 114 is particularly advantageous which is configured in one piece in the form of a frame around the edge region of the substrate 112, with the result that the screen printing stencil carrier 110 and/or the screen printing stencil 111, during prepositioning in relation to the position with respect to the substrate 112, are/is centered with respect to the substrate 112 at the same time, with the result that precision positioning and orientation of the screen printing stencil carrier 110 and/or the screen printing stencil 111 in relation to the substrate 112 are no longer required.

The invention claimed is:

1. A screen printing screen, comprising:

a screen printing stencil carrier constructed as a film having first recesses extending from an upper side to an underside of the film, and a screen printing stencil constructed as a nonmetallic masking layer and fixedly connected to the underside of the screen printing stencil carrier, the masking layer disposed at least partially inside some of the first recesses of the film and extending from the underside of the film in the direction of the upper side of the film, without projecting beyond the upper side of the film, the masking layer comprising second recesses at least partially overlapping with the first recesses of the screen printing stencil carrier so as to enable a printing medium to pass through the first recesses from the upper side of the screen printing stencil carrier in the direction of the underside and through the second recesses of the masking layer to a substrate placed underneath.

2. The screen printing screen of claim 1, wherein the underside or the upper side, or both, of the film have a roughness Rz of less than 30 micrometers.

3. The screen printing screen of claim 1, wherein the underside or the upper side, or both, of the film have a roughness Rz of less than 2 micrometers.

4. The screen printing screen of claim 1, wherein the masking layer is formed from an emulsion.

5. The screen printing screen of claim 1, wherein the masking layer has a thickness in a range from 0.5 micrometer to 60 micrometers.

6. The screen printing screen of claim 1, wherein the masking layer comprises polyvinyl alcohol.

7. The screen printing screen of claim 1, wherein the screen printing stencil comprises a surface layer modifying wettability or passivation, or both, with respect to etching media.

8. The screen printing screen of claim 1, wherein the screen printing stencil carrier or the screen printing stencil, or both, comprise a projection protruding into a region of at least one of the first and second recesses, reducing a passage area for a printing medium.

9. The screen printing screen of claim 8, wherein at least one of the first recesses has an inlet opening for the printing medium on the corresponding upper side and an outlet opening printing for the medium on the corresponding underside, with an area of the inlet opening of the at least one of the first recess overlapping at most partly an area of the outlet opening of the at least one of the first recess, as viewed in a direction perpendicular to the area of the inlet opening.

10. The screen printing screen of claim 1, further comprising a spacer element disposed on the underside of the screen printing stencil carrier or the screen printing stencil, or both, wherein the spacer element is constructed to space the screen printing stencil carrier or the screen printing stencil from a plane, on which a substrate to be printed is placed.

11. The screen printing screen of claim 1, further comprising a frame having a clamping fabric for clamping the screen printing stencil carrier.

12. The screen printing screen of claim 11, wherein the screen printing stencil carrier includes depressions or openings, or both, and the clamping fabric forms a mesh, and wherein the clamping fabric and the screen printing stencil carrier are joined together by melted plastic entering the depressions or openings of the screen printing stencil carrier and the mesh of the clamping fabric.

* * * * *